United States Patent [19]

Schmidt et al.

[11] 4,024,707

[45] * May 24, 1977

[54] APPARATUS FOR THE CONTROL OF AIR ADMISSION TO THE EXHAUST SYSTEM OF AN INTERNAL COMBUSTION ENGINE INCLUDING A SAFETY CIRCUIT MEANS

[75] Inventors: Peter Jürgen Schmidt, Schwieberdingen; Harald Kizler, Stuttgart, both of Germany

[73] Assignee: Robert Bosch G.m.b.H., Stuttgart, Germany

[ * ] Notice: The portion of the term of this patent subsequent to Sept. 9, 1992, has been disclaimed.

[22] Filed: May 9, 1975

[21] Appl. No.: 575,995

[30] Foreign Application Priority Data

May 11, 1974 Germany ..... 2422938

[52] U.S. Cl. ..... 60/276; 60/277; 60/289

[51] Int. Cl.[2] ..... F01N 3/10

[58] Field of Search ..... 60/289, 276, 277; 123/124 R, 124 B, 198 D, 32 EA

[56] References Cited

UNITED STATES PATENTS

| | | | |
|---|---|---|---|
| 3,745,768 | 7/1973 | Zechnall et al. | 60/276 |
| 3,782,347 | 1/1974 | Schmidt et al. | 60/276 X |
| 3,832,848 | 9/1974 | Scholl | 60/289 X |
| 3,903,853 | 9/1975 | Kizler et al. | 60/285 X |

*Primary Examiner*—Carlton R. Croyle
*Assistant Examiner*—Thomas I. Ross
*Attorney, Agent, or Firm*—Edwin E. Greigg

[57] ABSTRACT

An internal combustion engine which is provided with an exhaust gas treatment system, such as thermal or catalytic reactors, includes a primary regulating system for admitting fresh air to the exhaust system for the chemical processes taking place in the reactors. This fresh air regulation depends on the engine rpm and on the induction tube pressure. There is also provided a secondary air control system, including a three-way valve and an electronic controller and an oxygen probe, located in the exhaust manifold. The probe supplies the controller with a signal related to the oxygen concentration in the exhaust gas and the controller uses this signal to actuate the three-way valve which admits either induction tube pressure or, alternatively, exhaust system pressure, to a control chamber in the primary regulating system, thereby influencing the quantity of fresh air supplied to the exhaust manifold of the engine.

3 Claims, 3 Drawing Figures

O2 - SENSOR VOLTAGE
λ
0,8 0,9 1 1,1 1,2 1,3
40
41
43
44
45
46
47
48
49
50
51
52
53
54
55
56
57
58
59
60
61
62
63
64
65
66
67
68
69
70
80
81

APPARATUS FOR THE CONTROL OF AIR ADMISSION TO THE EXHAUST SYSTEM OF AN INTERNAL COMBUSTION ENGINE INCLUDING A SAFETY CIRCUIT MEANS

BACKGROUND OF THE INVENTION

The invention relates to a control apparatus for regulating the addition of supplementary fresh air to the exhaust gas of an internal combustion engine. The engine is of the type which includes an exhaust gas post-combustion system located in the exhaust system and an oxygen sensor, also located in the exhaust system, for monitoring the composition of the exhaust gas.

It is known to provide detoxication systems for internal combustion engines, which include thermal and/or catalytic reactors for transforming toxic exhaust constituents, such as carbon monoxide (CO), hydrocarbons ($C_xH_y$) and oxides of nitrogen ($NO_x$) into harmless chemical compounds. Since an internal combustion engine is normally operated with variable load factors, the composition of the exhaust gases is subject to changes. These changes disturb the post-treatment of the exhaust gas in the thermal and/or catalytic reactors, with the result that the oxygen content of the exhaust gas is sometimes too high and sometimes too low. In order to avoid this disadvantage, it is known to operate the internal combustion engine with a shortage of air ($\lambda > 1.0$) and to supply the air required for combustion in the post-treatment system by means of an air pump driven by a motor. An arrangement of that type is described and illustrated in German laid-open specification No. 2,035,591.

It is also known to regulate the admission of supplementary air to the exhaust gas in dependence on the induction tube pressure and on the rpm of the internal combustion engine. In such a known regulator, an auxiliary control loop superimposes a precise adjustment of the supplementary air quantity in dependence on the composition of the exhaust gas. An arrangement of that type is described and illustrated in German allowed application No. 2,254,961.

OBJECT AND SUMMARY OF THE INVENTION

Based on these known apparatuses, it is a principal object of the invention to provide an electrical control apparatus which permits an exact control of the amount of supplementary air in dependence on the composition of the exhaust gas. It is a further object of the invention to provide a control apparatus which is as simple and as inexpensive to construct as possible and which operates reliably even under the extreme operational demands occurring during use in a motor vehicle. It is a still further object of the invention to provide an electric control apparatus which supplies the maximum supplementary air quantity during the warm-up phase of the internal combustion engine, i. e., during a time when the oxygen sensor, located in the exhaust line of the internal combustion engine, is not yet capable of providing a clear and unambiguous output signal. It is yet another object of the invention to provide an electric control apparatus which provides the maximum possible amount of supplementary air to the exhaust gas whenever there is a short circuit or a failure of the electrical connections in the input circuit which contains the oxygen sensor.

These and other objects are attained by the invention by providing that the oxygen sensor is connected to a threshold commutator (comparator) which controls a first switching transistor. Depending on its state, and in particular via an amplifying output stage, this first switching transistor controls the current through the actuating windings of a solenoid valve which, in known manner, increases or reduces the supplementary air quantity provided to the exhaust gas.

The invention will be better understood as well as further objects and advantages thereof will become more apparent from the ensuing detailed specification of a exemplary embodiment taken in conjunction with the drawing.

DESCRIPTION OF THE PREFERRED EMBODIMENT

Figure 1:
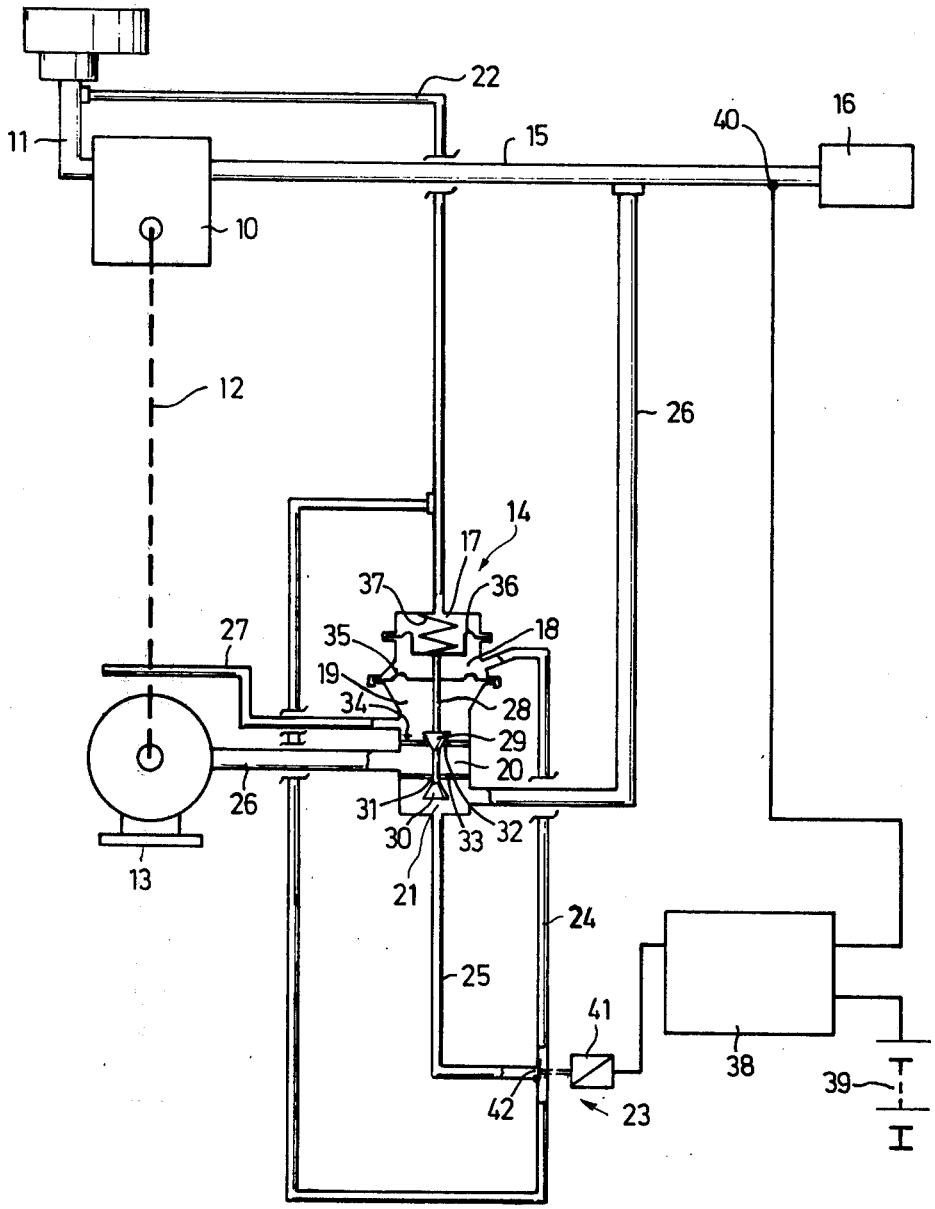
FIG. 1 is a schematic representation of an internal combustion engine which includes a primary regulating system for regulating the supplementary air provided to the exhaust gas and also includes a control apparatus, whose actions are superimposed on the regulator for the precise adjustment of the amount of supplementary air.

Turning now to FIG. 1, there may be seen an internal combustion engine 10 which has an induction tube 11 through which it aspirates a fuel-air mixture, prepared, for example, by a carburetor (not shown). The internal combustion engine 10 drives an air pump 13 via a suggested connection 12. The air pump 13 delivers air to a regulating system 14 in dependence on the rpm of the internal combustion engine. The exhaust gases from the internal combustion engine 10 flow through an exhaust gas manifold 15 to a thermal and/or catalytic reactor 16, shown only schematically.

The regulator includes a first control pressure chamber 17 and a second control pressure chamber 18. Furthermore, the regulator 14 includes a first pressure chamber 19, a second pressure chamber 20, and a third pressure chamber 21. Terminating in the first control pressure chamber 17 is a first pressure line 22 communicating with the induction tube 11. This pressure line 22 also communicates with one port of a three-way valve 23 serving as the regulator's final control element. Connected to the second control pressure chamber 18 is a second pressure line 24 leading to another one of the ports of the three-way valve 23. The third port of the three-way valve 23 is connected to a third pressure line 25 which leads to the third pressure chamber 21. An air supply line 26 connects the third pressure chamber 21 with the exhaust gas manifold 15. The air supply line 26 leads from the air pump 13 to the second pressure chamber 20 and an air return line 27 leads from the first pressure chamber 19 to the atmosphere.

The interior of the regulating system 14 contains a guide rod 28 on which are fastened two metering cones 29 and 30 which can open or close apertures 31 and 32, located, respectively, in separating walls 33 and 34. The separating walls 33 and 34 define the pressure chambers 29, 20 and 21. The first pressure chamber 19 is separated from the second control pressure chamber 18 by a diaphragm 35 and the first control pressure chamber 17 and the second control pressure chamber 18 are separated by a diaphragm 36. These two diaphragms are both attached to the guide rod 28. The diaphragm 36 is loaded by a compressive spring 37 in the direction which tends to open the aperture 31. The three-way valve 23 is actuated by a control apparatus 38 which is connected to a source of electric potential 39. The control apparatus 38 actuates the three-way valve 23 in dependence on the composition of the exhaust gas within the exhaust gas manifold 15 as monitored by an oxygen sensor 40.

The above-described apparatus functions as follows:

The exhaust gas manifold 15 is supplied with supplementary air basically in dependence on the rpm of the internal combustion engine and on the induction tube vacuum. As already suggested above, this is done, firstly, by operating the air pump 13 at the rpm of the internal combustion engine 10, and, secondly, by admitting induction tube pressure to the first control pressure chamber 17. Thus, when the induction tube pressure is high, the compressive spring 37 in the first control pressure chamber is released and the guide rod with the metering cones 29 and 30 is displaced downwardly so that the effective opening 31 is increased while the effective opening 32 is decreased, so that a larger quantity of supplemetary air is delivered to the exhaust gas post-treatment system 16. The rpm-dependent and induction tube pressure-dependent regulation of the supplementary air quantity is further augmented by a control system governed by the control apparatus 38. This control system makes a fine adjustment of the quantity of supplementary air supplied to the exhaust gas manifold in dependence on the exhaust gas composition by actuating the three-way valve 23 to admit to the second control pressure chamber 18 either the exhaust gas counter pressure, through the air line 26 and through the third pressure line 25, or else the induction tube pressure, through the first pressure line and through the three-way valve. In this way, the diaphragms 35 and 36 are displaced in dependence on the control signal from the controller 38. This superimposed control process makes possible a very precise metering of the supplementary air quantity fed to the exhaust gas.

Figures 2, 3:
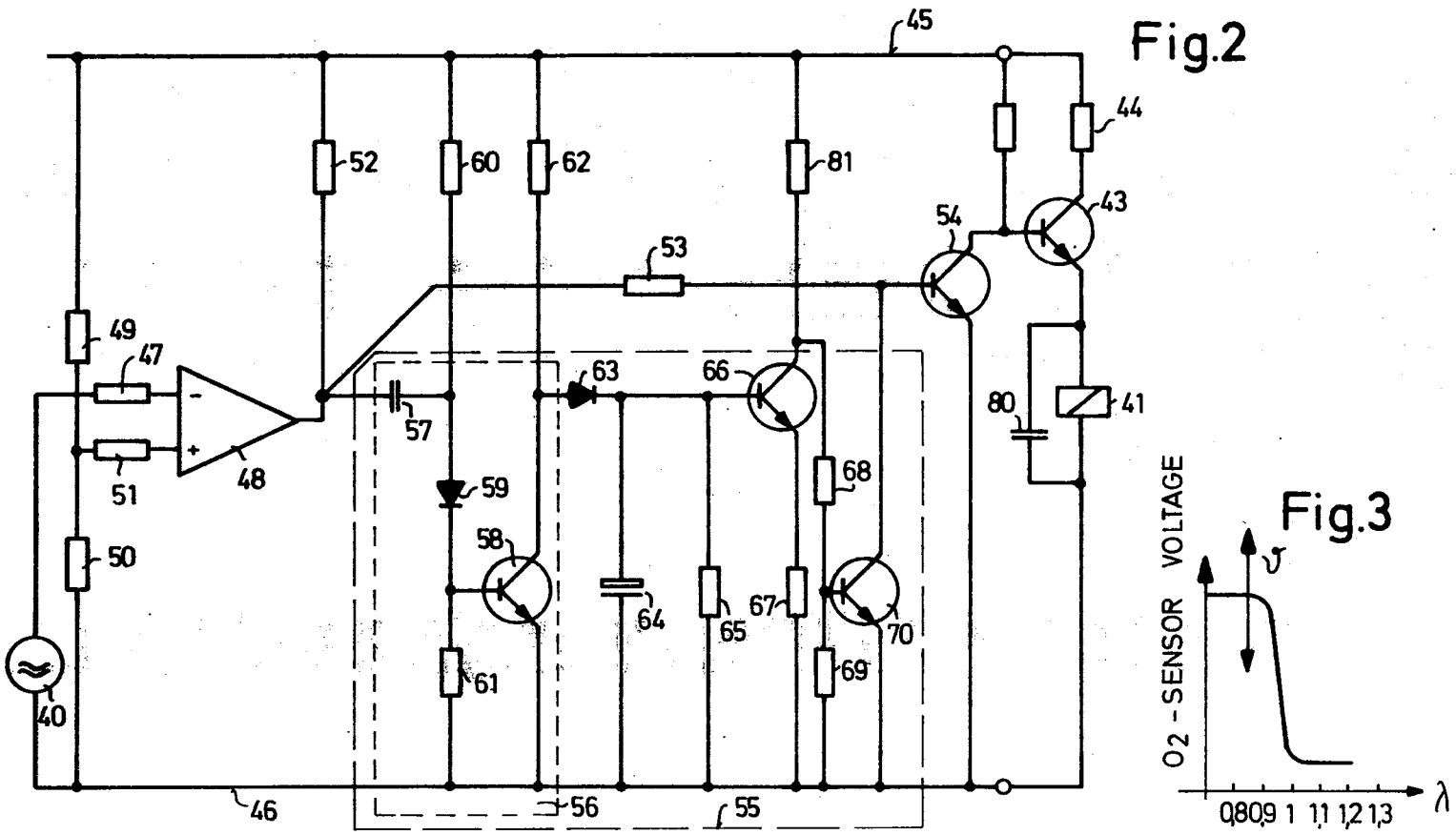
FIG. 2 is an electrical circuit diagram of the control apparatus for adjusting the supplementary air quantity and FIG. 3 is a diagram showing the output voltage of an oxygen sensor as a function of the air number $\lambda$.

FIG. 2 is the electric circuit diagram for the control apparatus 38 which actuates the three-way valve 23. In FIG. 2, acutating windings 41 of a solenoid magnet displace a baffle 42 in such a manner that, in one position, induction tube pressure is admitted to the second pressure line 24 and to the second control chamber 18 whereas, in the second position, exhaust gas counter pressure is admitted through the third pressure line and the second pressure line 24 and to the second control pressure chamber 18. The actuating windings 41 are connected in parallel with a capacitor to suppress transient peaks, and in series with a first switching transistor 43 whose collector is connected through a resistor 44 to the common positive supply line 45 leading to the source of potential 39. A second supply line 46 leads to the negative terminal of the source of potential and the other ends of the actuating windings 41 and of the capacitor 80 are connected to the positive supply line 46.

The first switching transistor is controlled in dependence on the output signal from the oxygen sensor 40, whose output voltage is a function of the composition of the exhaust gas. FIG. 3 is a diagram showing the output voltage of the oxygen sensor 40 as a function of the air number $\lambda$ which is related to the fuel-air mixture admitted to the engine. The ordinate of the curve in FIG. 3 represents the output voltage U of the oxygen sensor 40 and the abscissa represents the air number $\lambda$ in a region from approximately 0.8 to 1.3. When the fuel-air mixture is stoichiometric ($\lambda = 1$), the output voltage of the oxygen sensor changes virtually instantaneously. When the air number is less than 1.0 the output voltage from the sensor is high, whereas, when the air number is greater than 1.0, the output voltage is low. Air numbers less than unity (1.0) imply that the fuel-air mixture is rich and air numbers greater than 1.0 imply that the fuel-air mixture is lean. It should be noted that the magnitude of the output voltage from the oxygen sensor 40 is highly dependent on the temperatures within the exhaust gas system of the internal combustion engine. The oxygen sensor 40 is connected to an input resistor 47 and hence to the inverting input of an operational amplifier 48 serving as a threshold switch. The threshold value of the threshold switch 48 is determined by a voltage divider comprising resistors 49, 50 connected between the supply lines 45 and 46. The potential at the tap of the voltage divider is fed through an input resistor 51 to the non-inverting input of the operational amplifier 48. The output of the operational amplifier 48 is connected to a load resistor 52, which is connected to the supply line 45. The output of the operational amplifier 48 is further connected to a base resistor 53, connected to the base of an amplifier output stage 54 which switches the first switching transistor 43, embodied as a power transistor.

The output of the operational amplifier 48 is further connected to a safety circuit 55 including a monostable multivibrator 56. The monostable multivibrator includes a capacitor whose one electrode is directly connected to the output of the operational amplifier 48 and whose other electrode is connected through a diode to the base of a transistor 58. The anode of the diode 59 is connected through a resistor 60 to the common supply line 45. The cathode of diode 59 is connected to the base of transistor 58 and also to a resistor 61 which leads to the common supply line 46. The collector of transistor 58 is connected via a load resistor 62 to the common positive line and its emitter is directly connected to the common supply line 46. The collector of transistor 58 is also connected to the anode of a diode 63, whose cathode is coupled to one electrode of a storage capacitor 64, a resistor 65 and the base of a second switching transistor 66. One side of each of the storage capacitors 64 and the resistors 65 is connected to the common supply line 46. The collector of the second switching transistor 66 is connected, via a load resistor 81, to the positive supply line 45. Further connected to the collector of the second switching transistor 66 is a voltage divider comprising resistors 68, 69, wherein the resistor 69 leads to the common supply line 46, as does an emitter resistor 67. The tap of the voltage divider comprising resistors 68 and 69 is connected to the base of a third switching transistor 70 whose emitter is directly connected to the supply line 46 and whose collector is connected to the base of the transistor 54.

The method of operation of the above-described circuit is as follows:

When the oxygen sensor 40, located in the exhaust manifold 15, signals, for example, that the fuel-air mixture delivered to the internal combustion engine 10 is too rich, i.e. that the air number $\lambda$ is less than unity (1.0), then the output of the oxygen sensor 40 carries a positive potential during normal operational engine temperatures. This positive signal is fed to the inverting input of the operational amplifier 48 so that its output is a negative signal. This negative signal is transmitted via the resistor 53 to the base of the amplifying transistor 54 which is thereby blocked. The blockage of the amplifying transistor 54 causes a positive potential to appear at the base of the first switching transistor 43 and therefore renders it conducting. The current flowing through the first switching transistor 43 energizes the actuating windings 41 of the magnetic valve and moves the baffle 42 of the three-way valve 23 into a position in which the induction tube pressure is admitted to the second control pressure chamber 18. For this reason, the diaphragm 36 is pressure relieved from the direction of the second pressure control chamber 18 and the spring 37 is able to expand. As a consequence, the metering cones 29 and 30 in FIG. 1 are moved downwardly so that a greater quantity of fresh air is supplied to the exhaust gas.

If, on the other hand, the fuel-air mixture is too lean, the oxygen sensor provides a negative output signal. This negative signal causes the output of the operational amplifier 48 to be positive which renders the amplifying transistor 54 conducting. When the transistor 54 conducts, the first switching transistor 43 is blocked, the actuating windings are not energized and, hence, the baffle 42 of the three-way valve 23 remains in its second switching position, in which the exhaust gas counter pressure is admitted to the second control pressure chamber 18. As a consequence, the diaphragm 36 and the guide rod 28 are moved upwardly as are the metering cones 29 and 30. As a result, the admission of supplementary fresh air to the exhaust gas is reduced or, in the extreme case, completely stopped.

Finally, the operation of the safety circuit 55 is as follows:

During normal operation, the output of the operational amplifier 48 continuously alternates between positive and negative values. During each change of the output potential of the operational amplifier 48 from a positive to a negative value, the capacitor 57 places a negative potential on the anode of the diode 59. As a result, the transistor 58 is deprived of base current and the transistor blocks until such time as the capacitor 57 has been charged in the opposite sense.

While the monostable multivibrator 56 is blocking, the storage capacitor 64 can be charged through the resistor 62 and the diode 63, otherwise it discharges through the resistor 65. The periodic charging process suffices to charge the capacitor 64 sufficiently so that the potential appearing at the base of transistor 66 maintains the transistor 66 in a conducting state so that the transistor 70 remains blocked. Thus, the transistor 54 can operate normally as described above.

On the other hand, if a malfunction occurs, e.g., if a lower than normal exhaust gas temperature raises the internal resistance of the oxygen sensor 40 too much or if a short circuit occurs in the input circuit of the controller 38, then the output of the operational amplifier 48 remains constant at one or the other potential. Thus, the monostable multivibrator 56 is no longer triggered and, as a result, the transistor 58 always conducts. While the transistor 58 conducts, the diode 63 is blocked and the storage capacitor 64 is able to discharge continuously through the resistor 65. During the discharging process, a point is reached when the potential appearing at the base of transistor 66 becomes too low to maintain conduction through the transistor 66, which blocks. Therefore, a positive signal appears at its collector and provides a jpositive signal to the base of the third switching transistor 70 which therefore becomes conducting and blocks the amplifying transistor 54. This causes the first switching transistor 43 to conduct and energize the actuating widings 41 so that a maximum amount of air is supplied to the exhaust gas. Thus, it may be seen that, when malfunctions occur in the input circuit of the control apparatus 38, the exhaust system always operates with a very lean fuel-air mixture, keeping the concentration of toxic emissions in the exhaust gas very low.

What is claimed is:

1. In a regulating system for an internal combustion engine which includes an exhaust gas post-combustion system and an oxygen sensor, located in the exhaust system, for determining the chemical composition of the exhaust gases, and which further includes means for admitting air directly to said exhaust system, said means including at least one electromagnetic valve, the improvement comprising:

A. a control apparatus, connected to said oxygen sensor to receive signals therefrom and including
   i. a threshold switch, responsive to said signals from said oxygen sensor and delivering an output signal;
   ii. first transistor means, connected to be controlled by said output signal from said threshold switch; and connected to energize said at least one electromagnetic valve; whereby the quantity of air supplied to the exhaust gas of the engine may be changed; and B. safety circuit means, connected to receive said output signal from said threshold switch and operatively connected to said first transistor means; whereby, when said output signal from said threshold switch remains constant, the safety circuit means actuates said first transistor means to cause said means for admitting air to said exhaust system to admit the maximum amount of air.

2. A regulating system as defined in claim 1, wherein said safety circuit means includes:

i. a monostable multivibrator circuit, connected to receive said output signal from said threshold switch;
ii. first capacitor means, connected to the output of said monostable multivibrator circuit; and
iii. further transistor means, connected to be influenced by said first capacitor means and connected to control said first transistor means.

3. A regulating system as defined in claim 2, wherein said monostable multivibrator circuit includes:

a. second capacitor means, connected to receive said output signal from said threshold switch;
b. voltage divider means, comprising resistors and at least one diode, connected to said second capacitor means; and
c. third transistor means, whose base is connected to said voltage divider means and whose collector-emitter path is connected in parallel with a series connection of a diode and said first capacitor means.

* * * * *